US009357287B2

(12) United States Patent
Geschiere et al.

(10) Patent No.: US 9,357,287 B2
(45) Date of Patent: May 31, 2016

(54) MULTIPLE RECEIVER ASSEMBLY AND A METHOD FOR ASSEMBLY THEREOF

(75) Inventors: Onno Geschiere, Nieuw-Vennep. (NL); Mike Geskus, Purmerend (NL)

(73) Assignee: Sonion Nederland B.V., Hoofddorp (NL)

( * ) Notice: Subject to any disclaimer, the term of this patent is extended or adjusted under 35 U.S.C. 154(b) by 93 days.

(21) Appl. No.: 14/130,450

(22) PCT Filed: Jun. 29, 2012

(86) PCT No.: PCT/EP2012/062724

§ 371 (c)(1), (2), (4) Date: Dec. 31, 2013

(87) PCT Pub. No.: WO2013/004623

PCT Pub. Date: Jan. 10, 2013

(65) Prior Publication Data

US 2014/0153737 A1 Jun. 5, 2014

Related U.S. Application Data

(60) Provisional application No. 61/505,300, filed on Jul. 7, 2011.

(51) Int. Cl.

| | |
|---|---|
| ***H04R 1/10*** | (2006.01) |
| ***H04R 1/26*** | (2006.01) |
| ***H04R 31/00*** | (2006.01) |
| *H04R 1/34* | (2006.01) |
| *H04R 5/033* | (2006.01) |
| *H04R 25/00* | (2006.01) |

(52) U.S. Cl.

CPC ..... *H04R 1/1058* (2013.01); *H04R 1/26* (2013.01); *H04R 31/00* (2013.01); *H04R 1/1016* (2013.01); *H04R 1/345* (2013.01); *H04R 5/033* (2013.01); *H04R 25/48* (2013.01); *H04R 25/608* (2013.01)

(58) Field of Classification Search

None

See application file for complete search history.

(56) References Cited

U.S. PATENT DOCUMENTS

| | | | | |
|---|---|---|---|---|
| 6,853,735 | B2 * | 2/2005 | Imahori et al. | 381/418 |
| 8,509,468 | B2 * | 8/2013 | Van Halteren et al. | 381/355 |
| 2006/0251279 | A1 * | 11/2006 | Zei et al. | 381/322 |
| 2007/0053540 | A1 | 3/2007 | Harvey | |
| 2007/0223735 | A1 * | 9/2007 | LoPresti et al. | 381/99 |
| 2008/0063223 | A1 * | 3/2008 | van Halteren et al. | 381/182 |

(Continued)

FOREIGN PATENT DOCUMENTS

| | | |
|---|---|---|
| EP | 1895811 | 3/2008 |
| WO | 2007/022773 | 3/2007 |

OTHER PUBLICATIONS

International Search Report for International Application No. PCT/EP2012/062724, dated Sep. 4, 2012, 5 pages.

(Continued)

*Primary Examiner* — Paul Huber

(74) *Attorney, Agent, or Firm* — Nixon Peabody LLP

(57) ABSTRACT

A receiver assembly comprising a first and a second receiver housing and a spout. The second receiver housing is positioned over a first sound outlet port of the first receiver housing and the spout is positioned over a second outlet port of the second receiver housing. An acoustic duct is located between the first and second receiver housing acoustically connecting the first sound outlet port to the spout and is provided with an acoustic mass.

18 Claims, 4 Drawing Sheets

(56) References Cited

U.S. PATENT DOCUMENTS

| | | | | |
|---|---|---|---|---|
| 2009/0060245 | A1 | 3/2009 | Blanchard et al. | |
| 2012/0155694 | A1 * | 6/2012 | Reeuwijk et al. | 381/396 |

OTHER PUBLICATIONS

Written Opinion for International Application No. PCT/EP2012/062724, dated Sep. 4, 2012, 8 pages.

* cited by examiner

MULTIPLE RECEIVER ASSEMBLY AND A METHOD FOR ASSEMBLY THEREOF

CROSS REFERENCE TO RELATED APPLICATIONS

This application is a U.S. national stage filing of International Application No. PCT/EP2012/062724, filed Jun. 29, 2012, which claims the benefit of U.S. Provisional Patent Application No. 61/505,300, filed Jul. 7, 2011, the contents of these applications being incorporated entirely herein by reference.

FIELD OF THE INVENTION

The present invention relates generally to a receiver assembly including multiple receivers assembled jointly for playback of audio in headphones, hearing aid instruments and head sets.

BACKGROUND OF THE INVENTION

For playback of audio in headphones and hearing aids receivers are applied that convert an electric signal representing an audio stream into sound. A common type of receiver is the balanced armature type: an electro-acoustic transducer which converts energy from electrical energy to acoustical energy. Balanced armatures have limitations regarding the reproduction of sound due to e.g. nonlinearity of the flux field, saturation of the armature and mechanical compliance. The overall frequency response and bandwidth are affected by the design, dimension and construction of the balanced armature receiver. In particular, the balanced armature has typical resonant frequencies that influence frequency response. To address these limitations it is known to apply multiple receivers that are each designed to reproduce a specific portion of the sound frequency spectrum, such as e.g. tweeter, mid-range or woofer transducer assemblies reproducing high, mid and low frequency ranges respectively. As these frequency spectra may partially overlap, the joint frequency response of the receivers will be deficient likewise. To address this problem it is known to apply acoustic filters acoustically downstream. These are placed outside the spout of the receiver, but necessitate a complicated construction of the earphone itself to bring the sound of two receivers together into one acoustic channel to deliver the sound to the ear of a user. This means additional volumes affecting mainly the reproduction of higher frequencies. Moreover, installing such a receiver assembly in e.g. an ear phone product is more difficult and thus time consuming; which in turn increase costs of manufacture. In order to reduce the amount of space taken up by a multiple receiver assembly, dual receiver assemblies have been developed wherein two transducer assemblies are combined in a single housing with a single spout; usually a combination of a woofer and a tweeter or a woofer and a mid-range receiver. To further reduce the amount of space taken up by a dual receiver assembly, in U.S. 2009/0060245 it is disclosed to apply a constriction plate with a generally circular shaped aperture located inside the spout, instead of a complex construction outside of the spout. The aperture functions as an acoustic low pas filter and is applied to the sound outlet port of a woofer transducer assembly. However, the filter response of the circular aperture in the constriction plate is strongly non-linear resulting in undesirably high time harmonic distortions.

It is an object of the present invention to provide a receiver assembly that overcomes the drawbacks mentioned above.

DESCRIPTION OF THE INVENTION

In a FIRST aspect, the present invention relates to a receiver assembly comprising a first receiver housing comprising a first sound outlet port; a second receiver housing comprising a second sound outlet port and a spout, and wherein the second receiver housing is positioned over the first sound outlet port. The receiver assembly further comprising an acoustic duct located between the first and second receiver housing acoustically connecting the first sound outlet port to the spout; and an acoustic mass positioned in an end portion of the acoustic duct close to the spout. Applying an acoustic mass in the acoustic duct of a receiver assembly according to the first aspect of the invention has the effect of the output of the first receiver as being passed through a low pass filter. Moreover, as for a common dual receiver the dimensions of the housing for each transducer are the same the overall frequency response is compromised: the dimensions are only optimal for one of the transducer assemblies or even sub-optimal for both transducer assemblies. The merging of the respective frequency response of each receiver is achieved according to the first aspect of the invention without compromising the overall response by the chosen design, as the first and second housing can be dimensioned to their respective frequency ranges: woofer and mid-range or tweeter.

In a further embodiment, the acoustic duct comprises a chamber and a passage, wherein the passage runs from the chamber towards the spout. The chamber allows proper acoustic connection between the acoustic duct and the first sound outlet of the first receiver, while the passage allows ease of accurately positioning and fitting the acoustic mass in the end portion of the acoustic duct.

In a preferred embodiment, the acoustic duct is provided as a spacer member. This assures a predetermined distance between the first and second receiver to accommodate the acoustic mass. In a further embodiment, the spacer member comprises a plate with a cut-out portion, the cut-out portion constituting the chamber, passage and a recess. When fixating the acoustic mass in the passage of the acoustic duct with glue, a recess at the end of the passage on the edge of the plate prevents the glue from entering the acoustic mass. Furthermore, the spacer member can be shaped such that the plate extends beyond the dimension of the receivers allowing it to function as bracket member facilitating ease of installing the receiver assembly in e.g. an earphone or headset.

In one embodiment, the outlet port of the second receiver is acoustically connected directly to the spout. In this manner, the acoustic output of both receivers is merged in a single spout. In another embodiment, the outlet port of the second receiver is connected to the acoustic duct. This provides the possibility to have a dual woofer assembly of which the joint acoustic output is passed through a low pass filter. Hence, both first and second receiver are provided with a woofer motor assembly giving an improved acoustic performance in the low frequency range. Such a dual woofer assembly can be advantageously in a three driver two way setup or a four driver three way setup; receiver assemblies with respectably three or four acoustic drivers wherein two drivers are arranged to produce a same frequency response.

In a SECOND aspect, the present invention relates to a method for assembling a receiver assembly comprising: providing a first receiver housing comprising a first sound outlet port, a second receiver housing comprising a second sound outlet port and providing an acoustic duct, positioning the second receiver housing over the sound outlet port of the first receiver housing, and positioning the acoustic duct between the first and second receiver housing such that it is located over the first sound outlet port of the first receiver and acoustically connected with the first sound outlet port and that an end portion of the acoustic duct is located near the second sound outlet port. The method further comprises positioning of an acoustic mass in the end portion of the acoustic duct and placing a spout over the second sound outlet port and the end portion of the acoustic duct. Mounting the second receiver over the sound outlet port of the first receiver facilitates locating the acoustic duct between the first and second receiver such that the acoustic duct runs from the first sound outlet port towards the spout. The thus provided acoustic connection between the first sound outlet port and the spout facilitates positioning an acoustic mass. A consequently therein located acoustic mass provides an acoustic low pass filter function.

In a preferred embodiment the method further comprise s providing the acoustic duct as a spacer member, and prior to positioning the acoustic duct between the first and second receiver housing, mounting the acoustic duct to the second receiver housing such that the end portion of the acoustic duct is located near the second sound outlet port of the second receiver housing. By providing the acoustic duct as a spacer member allows two receivers to be assembled in a simple manner; first mounting the acoustic duct c.q. spacer member to the second receiver facilitates ease of aligning the acoustic duct with the first sound outlet port of the first receiver.

According to a further embodiment, the method comprises applying glue to fixate the acoustic mass. This allows sealing off any clefts or openings between an outer diameter of the acoustic mass and an inner diameter of the acoustic duct.

In general, in a receiver assembly as described above the receivers are spaced apart to accommodate the acoustic duct and results in a more complex structure in comparison with a common dual receiver. However, applying the acoustic mass facilitated by the acoustic duct provides a universal, accurate, flexible, and more linear method to determine acoustic impedance and in particular a low pass crossover point. This allows improved control for determining and even flattening of the frequency characteristic of the receiver assembly.

In the context of the present invention the term 'receiver housing' shall designate any housing apt for a transducer assembly comprising a motor assembly driving a diaphragm and capable of producing sound in response to activation of the transducer assembly.

BRIEF DESCRIPTION OF THE FIGURES

The invention will now be described in further detail with reference to the accompanying drawings, wherein.

DETAILED DESCRIPTION

Figure 1:
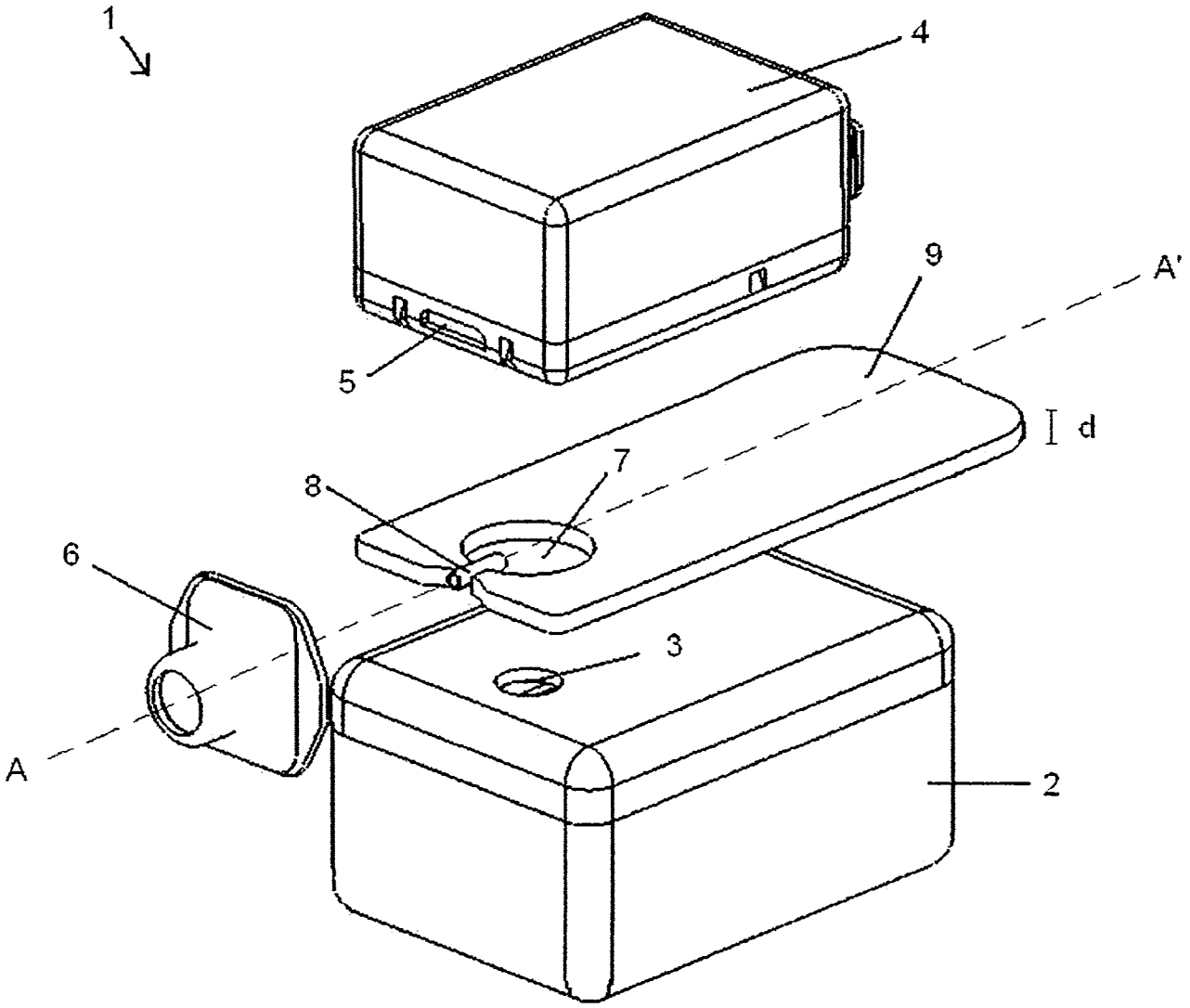
FIG. 1 is an exploded perspective view of an example of a receiver assembly according to aspects of the invention.
Figure 2:
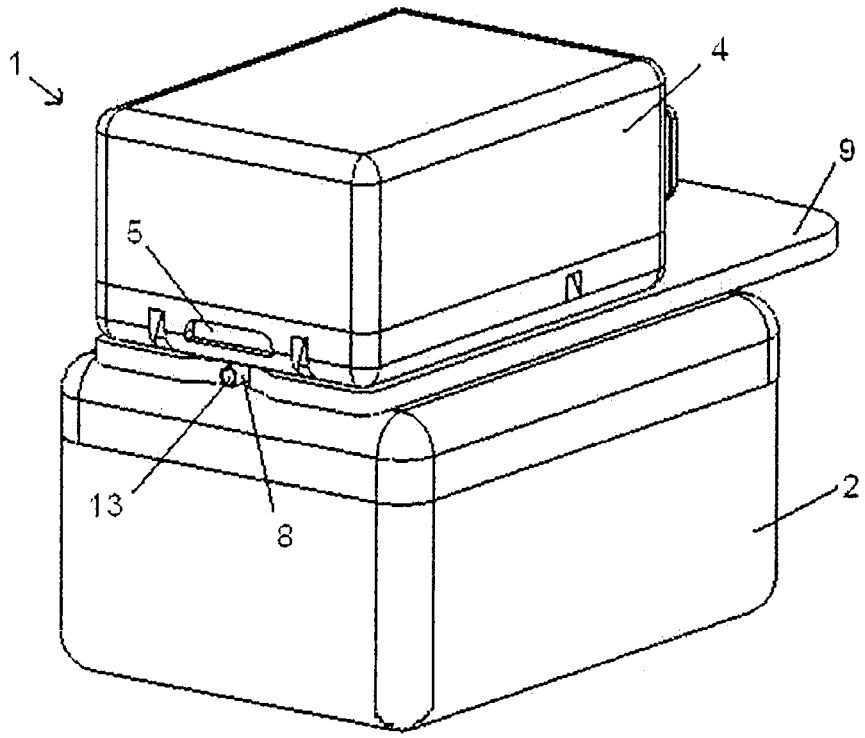
FIG. 2 is a perspective view of the assembly of FIG. 1 partially assembled.

An example of an embodiment of a receiver assembly 1 according to the invention is shown in FIG. 1. A method for assembling the receiver assembly 1 comprises providing a first receiver housing 2 comprising a first sound outlet port 3 and a second receiver housing 4 comprising a second sound outlet port 5. Further provided are a spout 6, an acoustic duct 7 and an acoustic mass 8. The second receiver housing 4 is positioned over the first sound outlet port 3 of the first receiver housing 2, while the acoustic duct 7 is positioned between the first receiver housing 2 and the second receiver housing 4. The acoustic duct 7 is positioned such that it is located over the first sound outlet port 3 of the first receiver 2, acoustically connected with the first sound outlet port 3, and that end portion of the acoustic duct 7 is located near the second sound outlet port 5 of the second receiver housing 4. The acoustic mass 8 is positioned in the end portion of the acoustic duct 7 and a spout 6 is placed over the second sound outlet port 5 and the end portion of the acoustic duct 7. In this embodiment, the acoustic duct 7 is provided as a spacer member, i.e. a plate 9 having a certain thickness d, wherein a cut-out portion constitutes the acoustic duct 7 when it is positioned between the receiver housings 2, 4. FIG. 2 shows the assembled receiver housings 2, 4 and plate 9 in-between. Prior to positioning the acoustic duct 7 between the first receiver housing 2 and the second receiver housing 4, the acoustic duct 7, in this embodiment the plate 9, is mounted to the second receiver housing 4 such that the end portion of the acoustic duct 7 is located near the second sound outlet port 5 of the second receiver housing 4. This makes it easier to position the acoustic mass 8 in the end portion of the acoustic duct 7. Glue is applied to fixate the acoustic mass 8, filling any clefts left between the outer side of the acoustic mass 8 and the inner side of the acoustic duct 7. This also prevents any sound coming from the first sound outlet port 3 from circumventing the acoustic mass 8. Once glued, the spout 6 can be mounted over the second sound outlet port 5, in this embodiment shaped as a slit, and the outlet 13 of acoustic mass 8.

The according to the above obtained assembly 1 comprises first receiver housing 2 comprising a first sound outlet port 3, second receiver housing 4 comprising second sound outlet port 5 and a spout 6. In the assembly the second receiver housing 4 is positioned over the first sound outlet port 3, while the spout 6 is positioned over the second outlet port 5. Furthermore, the acoustic duct 7 is located between the first receiver housing 2 and the second receiver housing 4 and acoustically connects the first sound outlet port 3 to the spout 6. The acoustic mass 8 is positioned in the end portion of the acoustic duct 7 close to the spout 6. In this embodiment, the acoustic mass 8 comprises a tube in cross-section having an inner contour of circular shape. However, other cross-sectional shapes as square or hexagonal shapes are also possible. The outer diameter of the tube corresponds to the inner diameter of the end portion of the acoustic duct 7. The choice for the dimensions of the tube, length and inner diameter, depends on the desired corner frequency. Especially the inner diameter is set for tuning the corner frequency, e.g. an inner diameter of 0.1 mm results in a corner frequency 100 Hz (subwoofer), while 0.2 mm results in a corner frequency 1 kHz. The inner diameter is usually selected from 0.1 to 0.7 mm. The length can be chosen anywhere between 0.5 and 5 mm.

Figure 3:
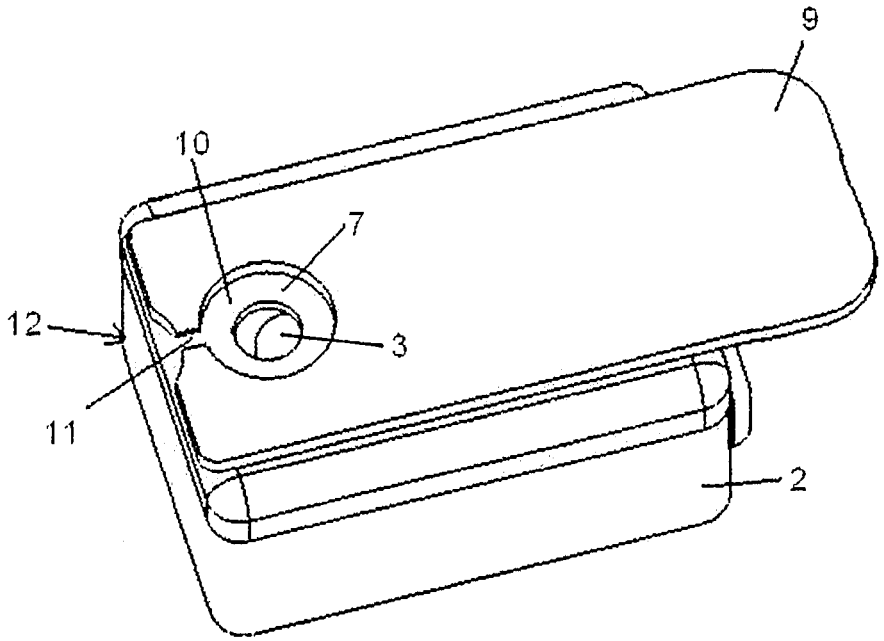
FIG. 3 is top view of the lower receiver of the receiver assembly of FIG. 1.

FIG. 3 shows the first sound outlet port 3, in this embodiment a circular shaped hole in receiver housing 2, acoustically connected to a chamber 10 of the acoustic duct 7. The chamber 10 preferably has a diameter larger than the diameter of the first sound outlet port 3. The acoustic duct 7 further comprises a passage 11 that runs from the chamber 10 to the side of the receiver assembly 1 where the spout 6 is to be mounted; accordingly when the spout 6 is mounted the passage 11 runs towards the spout 6. At the end of passage 11 running towards the spout 6 a recess 12 is left out, which aims to prevent glue from running into the tube 8 when being fixated in the passage 11. In another embodiment, it may suffice to have the diameter of the passage 11 expand at the edge of plate 9.

As best seen in FIG. 3 the acoustic duct is provided as cut-out portion in plate 9, wherein the cut-out portion constitutes the chamber 10, the passage 11 and recess 12. In another embodiment, the acoustic duct may be provided in the outer surface of the first or second receiver housing 2, 4: e.g. as a cut-out or grooved portion. In yet another embodiment, corresponding cut-out portions may be provided in the surface of both receiver housings which when assembled constitute the acoustic duct.

Plate 9 operates as a spacer member, providing a predetermined distance between the receiver housings 2, 4. The distance there between corresponds to the thickness of the plate. The thickness can be chosen such as to accommodate the acoustic mass, in this embodiment the outer diameter of tube 8. This allows the use of off-the-shelf receivers without the necessity of adapting the surface of the receiver housings or other additional measures to be able to position the acoustic mass between the receiver housings. Furthermore, the plate can be provided with means for attaching the receiver assembly to the inside of the casing of an earphone or hearing aid, thus functioning as a bracket member.

In the receiver assembly 1, the first receiver housing 2 preferably comprises a woofer transducer assembly and the second receiver housing 4 preferably comprises a mid-range transducer assembly or a tweeter transducer assembly. Thus, the receiver assembly operates as woofer-midrange or woofer-tweeter dual receiver assembly.

Figure 4:
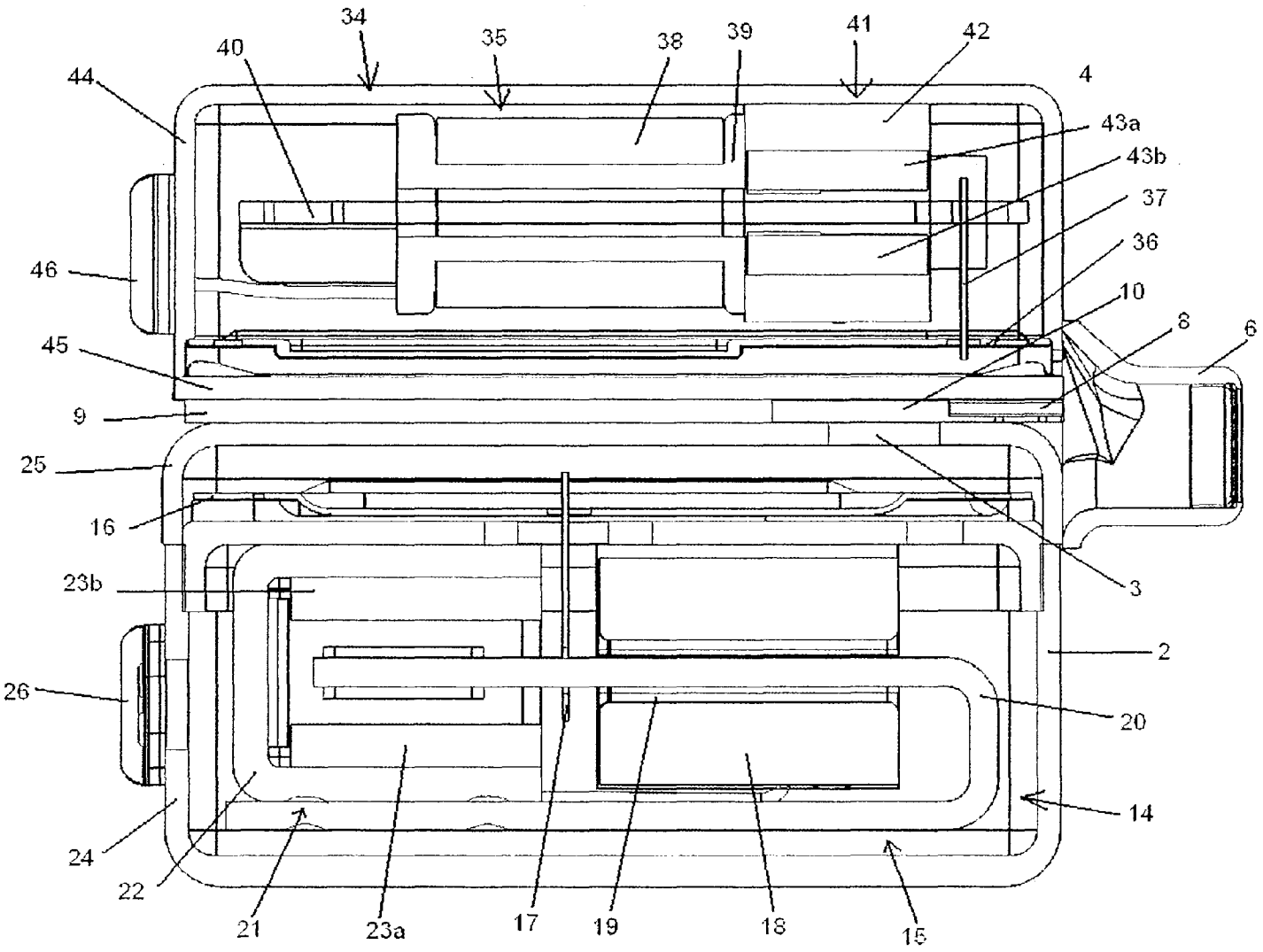
FIG. 4 is a cross-section view of the receiver assembly of FIG. 1.

Referring to FIG. 4 there is shown a cross-section of the receiver assembly along line A-A' as shown in FIG. 1. Shown are the transducer assemblies located respectively in the first and second receiver housings 2, 4 of this embodiment. The first receiver housing 2 houses a woofer transducer assembly 14 designed for producing sounds in the bass region of the audio spectrum. The woofer transducer assembly 14 comprises a motor assembly 15 driving a diaphragm 16 through a driving pin 17. The motor assembly 15 comprises a coil wire 18 wound around a bobbin 19, an armature 20 of U-shaped type and a magnet assembly 21. The magnet assembly comprises a magnet housing 22 and a pair of magnets 23*a*, 23*b*. The first receiver housing is made up of a case 24 and a cover 25. The case 24 is provided with connectors 26 for connecting a source of electric signals, representing e.g. audio signals for playback, to the transducer assembly 14.

The second receiver housing 4 houses a tweeter transducer assembly 34 designed for producing sounds in the upper region of the audio spectrum. The tweeter transducer assembly 34 comprises a motor assembly 35 driving a diaphragm 36 through a driving pin 37. The motor assembly 35 comprises a coil wire 38 wound around a bobbin 39, an armature 40 of the E-shaped type and a magnet assembly 41. The magnet assembly comprises a magnet housing 42 and a pair of magnets 43*a*, 43*b*. The second receiver housing 4 is made up of a case 44 and a cover 45. The case 44 is provided with connectors 46 for connecting a source of electric signals, representing e.g. audio signals for playback, to the transducer assembly 34.

The transducer assemblies operate as follows. Electric audio signals are transferred to each motor assembly 15, 35. Current running through the coils 18, 38 cause movement of the respective armatures 20, 40 which by means of the driving pins 17, 37 drive their respective diaphragms 16, 36. The induced vibrations of the diaphragms 16, 36 are transferred to the air located above the diaphragms. The vibrating air in the receiver housing constitute the sound waves produced by the receivers.

As explained above, between the first and second receiver housing 2, 4 the plate 9 is positioned with chamber 10 acoustically connected to the first sound outlet port 3. The sound produced by the woofer transducer assembly 14 in the first receiver housing 2 passes through the acoustic duct 7 and through the tube 8. The tube 8 acts as acoustic impedance and thus operates as acoustic low pass filter with a predetermined corner frequency corresponding to the design and dimensions of the tube 8. The filtered sound of the woofer assembly is joined with the sound of the tweeter assembly within the spout 6 and can travel further through a single sound channel.

Figure 5:
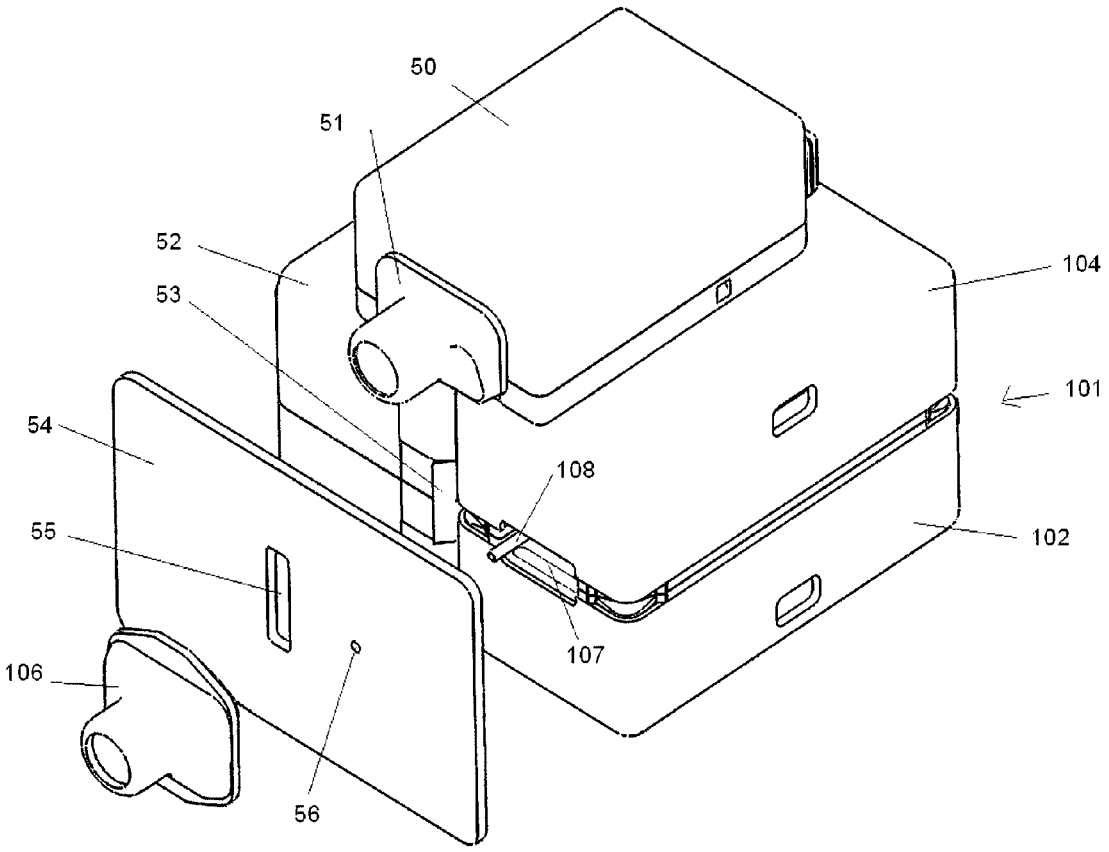
FIG. 5 is a perspective view of an example of a four driver three way setup according to aspects of the invention.

FIG. 5 shows a four driver three way setup having four drivers i.e. transducers producing three different frequency spectra. This receiver assembly has a dual woofer receiver assembly 101, a mid-range receiver 52 and a tweeter receiver 50. The tweeter receiver 50 has a separate spout 51. The mid-range receiver 52 has a sound outlet port 53. The dual woofer assembly 101 has a first woofer receiver 102 and a second woofer receiver 104. The sound outlet ports of both woofer receivers 102, 104 are both acoustically connected to an acoustic duct. A tube 108 is located in the acoustic duct 107. A plate or bracket 54 is positioned over the front of the dual woofer receiver assembly 101 and mid-range receiver. The plate 54 has a slit 55 for passing sound from the sound outlet port 53 of the mid-range receiver and a hole 56 through which tube 108 is placed. The inner diameter of hole 56 is adapted to the outer diameter of the tube 108 to provide n acoustically sealing fit. A spout 106 is positioned over the slit 55 and tube 108 extending through hole 56.

Each of these embodiments and obvious embodiments thereof is contemplated as falling within the spirit and scope of the invention.

What is claimed is:

1. A receiver assembly, comprising:

a first receiver housing comprising a first sound outlet port;

a second receiver housing comprising a second sound outlet port;

a spout;

wherein the second receiver housing is positioned over the first sound outlet port;

further comprising an acoustic duct located between the first and second receiver housing acoustically connecting the first sound outlet port to the spout; and an acoustic mass positioned in an end portion of the acoustic duct close to the spout.

2. A receiver assembly according to claim 1, wherein the acoustic mass comprises a tube.

3. A receiver assembly according to claim 1, wherein the acoustic mass has an outer diameter corresponding to the inner diameter of the end portion of the acoustic duct.

4. A receiver assembly according to claim 1, wherein the acoustic mass in cross-section has an inner contour of circular shape.

5. A receiver assembly according to claim 1, wherein the acoustic mass has an inner diameter between 0.1 and 0.7 mm.

6. A receiver assembly according to claim 1, wherein the acoustic duct comprises a chamber and a passage, wherein the passage runs from the chamber towards the spout.

7. A receiver assembly according to claim 6, wherein the acoustic duct further comprises a recess at an end of the passage running towards the spout.

8. A receiver assembly according to claim 1, wherein the acoustic duct is located in the outer surface of the first receiver housing, the second receiver housing or both receiver housings.

9. A receiver assembly according to claim 1, wherein the acoustic duct is provided as a plate with a cut-out portion.

10. A receiver assembly according to claim 1, wherein the first sound outlet port is a circular shaped hole in the first receiver housing.

11. A receiver assembly according to claim 1, wherein the second outlet port is acoustically connected directly to the spout.

12. A receiver assembly according to claim 1, wherein the first receiver housing comprises a woofer transducer assembly; and wherein the second receiver housing comprises a mid-range transducer assembly or a tweeter transducer assembly.

13. A receiver assembly according to claim 1, wherein the second outlet port is acoustically connected to the acoustic duct.

14. A receiver assembly according to claim 13, wherein the first and second receiver housing each comprise a woofer transducer assembly.

15. A receiver assembly according to claim 1, wherein the acoustic mass has an extended form separate from the first and second receiver housings, the extended form having dimensions for tuning a corner frequency.

16. A method for assembling a receiver assembly, comprising:

providing a first receiver housing comprising a first sound outlet port, a second receiver housing comprising a second sound outlet port and providing an acoustic duct;

positioning the second receiver housing over the sound outlet port of the first receiver housing;

positioning the acoustic duct between the first and second receiver housing such that it is located over the first sound outlet port of the first receiver housing and acoustically connected with the first sound outlet port and that an end portion of the acoustic duct is located near the second sound outlet port;

positioning an acoustic mass in the end portion of the acoustic duct; and placing a spout over the second sound outlet port and the end portion of the acoustic duct.

17. A method for assembling a receiver assembly according to claim 16, further comprising providing the acoustic duct as a spacer member; and prior to positioning the acoustic duct between the first and second receiver housing, mounting the acoustic duct to the second receiver housing such that the end portion of the acoustic duct is located near the second sound outlet port of the second receiver housing.

18. A method for assembling a receiver assembly according to claim 16, further comprising: applying glue to fixate the acoustic mass.

* * * * *